US008810617B2

(12) United States Patent
Bouverie et al.

(10) Patent No.: US 8,810,617 B2
(45) Date of Patent: Aug. 19, 2014

(54) APPARATUS AND METHOD FOR DETERMINING AND ADJUSTING PRINTHEAD PRESSURE

(75) Inventors: William M. Bouverie, Windermere, FL (US); Mark Allen Hitz, Rock Hill, SC (US); Dwayne Steven Tobin, Longwood, FL (US); Marjorie Hitz, legal representative, Rock Hill, SC (US)

(73) Assignee: Datamax-O'Neil Corporation, Orlando, FL (US)

( * ) Notice: Subject to any disclaimer, the term of this patent is extended or adjusted under 35 U.S.C. 154(b) by 99 days.

(21) Appl. No.: 13/530,454

(22) Filed: Jun. 22, 2012

(65) Prior Publication Data

US 2012/0327153 A1 Dec. 27, 2012

Related U.S. Application Data

(60) Provisional application No. 61/500,719, filed on Jun. 24, 2011.

(51) Int. Cl.
*B41J 2/32* (2006.01)

(52) U.S. Cl.
USPC ..... 347/198

(58) Field of Classification Search
USPC ..... 347/171, 197, 198; 400/120.16, 120.17
See application file for complete search history.

(56) References Cited

U.S. PATENT DOCUMENTS

| | | | |
|---|---|---|---|
| 4,143,977 | A | 3/1979 | Kurihara et al. |
| 4,177,731 | A | 12/1979 | Kleist et al. |
| 4,788,558 | A | 11/1988 | Caldwell et al. |
| 4,788,559 | A | 11/1988 | Ende |
| 4,872,659 | A | 10/1989 | Kato et al. |
| 4,924,240 | A | 5/1990 | Herbert et al. |
| 4,991,846 | A | 2/1991 | Sondej |
| 5,028,155 | A | 7/1991 | Sugiura et al. |
| 5,087,137 | A | 2/1992 | Burnard et al. |
| 5,206,662 | A | 4/1993 | Fox et al. |
| 5,326,182 | A | 7/1994 | Hagstrom |
| 5,397,192 | A | 3/1995 | Khormaee |
| 5,468,076 | A | 11/1995 | Hirano et al. |

(Continued)

FOREIGN PATENT DOCUMENTS

JP 04552558 B2 9/2010

OTHER PUBLICATIONS

Written Opinion of the International Searching Authority, PCT/US2012/036297, Jul. 17, 2012.

(Continued)

*Primary Examiner* — Kristal Feggins
(74) *Attorney, Agent, or Firm* — Carter, DeLuca, Farrell & Schmidt, LLP

(57) ABSTRACT

The present invention is directed to an apparatus and method for determining and adjusting printhead pressure of a thermal printer. The apparatus includes a printhead support housing operable for placement in a print station of a printer. A motor housed within the printhead support housing and being operable for driving a plurality of synchronized rotating gears, the gears being mounted about posts wherein the posts are configured to cause the gears to compress or decompress a set of biasing mechanisms mounted below the gears and connected to the printhead. A sensor unit operable for monitoring the thickness of a print media and in communication with a control circuit operable for adjusting the printhead pressure being applied to the print media during a print operation, wherein the printhead pressure corresponds to a pre-defined level relative to the thickness of the print media.

18 Claims, 4 Drawing Sheets

(56) References Cited

U.S. PATENT DOCUMENTS

| | | | |
|---|---|---|---|
| 5,490,638 | A | 2/1996 | Driftmyer et al. |
| 5,564,841 | A | 10/1996 | Austin et al. |
| 5,600,350 | A | 2/1997 | Cobbs et al. |
| 5,650,730 | A | 7/1997 | Herbst, Jr. |
| 5,684,516 | A | 11/1997 | Cseledy et al. |
| 5,790,162 | A | 8/1998 | Adams et al. |
| 5,820,280 | A | 10/1998 | Fox |
| 5,836,704 | A | 11/1998 | Lau et al. |
| 5,870,114 | A | 2/1999 | Numata et al. |
| 5,872,585 | A | 2/1999 | Donato et al. |
| 5,874,980 | A | 2/1999 | West |
| 5,909,233 | A | 6/1999 | Hamman et al. |
| 5,927,875 | A | 7/1999 | Lau et al. |
| 5,978,004 | A | 11/1999 | Ehrhardt |
| 5,995,128 | A | 11/1999 | Adams et al. |
| 6,014,229 | A | 1/2000 | Yun |
| 6,020,906 | A | 2/2000 | Adams et al. |
| 6,034,708 | A | 3/2000 | Adams et al. |
| 6,057,870 | A | 5/2000 | Monnier et al. |
| 6,070,048 | A | 5/2000 | Nonaka et al. |
| 6,082,914 | A | 7/2000 | Barrus et al. |
| 6,095,704 | A | 8/2000 | Jaeger et al. |
| 6,099,178 | A | 8/2000 | Spurr et al. |
| 6,129,463 | A | 10/2000 | Lau et al. |
| 6,201,255 | B1 | 3/2001 | Torchalski et al. |
| 6,283,024 | B1 | 9/2001 | George |
| 6,289,730 | B1 | 9/2001 | Elgee |
| 6,302,604 | B1 | 10/2001 | Bryant et al. |
| 6,389,241 | B1 | 5/2002 | Cernusak et al. |
| 6,396,070 | B1 | 5/2002 | Christensen et al. |
| 6,520,614 | B2 | 2/2003 | Kaneko |
| 6,616,362 | B2 | 9/2003 | Bouverie et al. |
| 6,825,864 | B2 | 11/2004 | Botten et al. |
| 6,840,689 | B2 | 1/2005 | Barrus et al. |
| 6,846,121 | B2 | 1/2005 | Bouverie et al. |
| 6,857,714 | B2 | 2/2005 | Hohberger et al. |
| 6,900,449 | B2 | 5/2005 | Bolash et al. |
| 6,942,403 | B2 | 9/2005 | Hohberger et al. |
| 7,042,478 | B2 | 5/2006 | Bouverie et al. |
| 7,071,961 | B2 | 7/2006 | Ullenius et al. |
| 7,079,168 | B2 | 7/2006 | Ullenius et al. |
| 7,150,572 | B2 | 12/2006 | McNestry et al. |
| 7,162,460 | B2 | 1/2007 | Cleckler et al. |
| 7,205,561 | B2 | 4/2007 | Chelvayohan et al. |
| 7,255,343 | B2 | 8/2007 | So |
| 7,375,832 | B2 | 5/2008 | Bouverie et al. |
| 7,456,995 | B2 | 11/2008 | Stephens |
| 7,502,042 | B2 | 3/2009 | Hitz et al. |
| 7,537,404 | B2 | 5/2009 | Bouverie et al. |
| 7,600,684 | B2 | 10/2009 | Tobin et al. |
| 7,667,874 | B2 | 2/2010 | MacDonald et al. |
| 7,699,550 | B2 | 4/2010 | Bouverie et al. |
| 7,824,116 | B2 | 11/2010 | Lyman |
| 7,845,632 | B2 | 12/2010 | Windsor et al. |
| 7,857,414 | B2 | 12/2010 | Eun et al. |
| 7,876,223 | B2 | 1/2011 | Yamaguchi et al. |
| 7,891,892 | B2 | 2/2011 | Chiu |
| 7,907,159 | B2 | 3/2011 | Matsuo et al. |
| 7,934,881 | B2 | 5/2011 | Lodwig et al. |
| 7,938,501 | B2 | 5/2011 | Takamiya et al. |
| 8,142,087 | B2 | 3/2012 | Kugimachi |
| 2001/0008612 | A1 | 7/2001 | Liljestrand et al. |
| 2003/0081024 | A1 | 5/2003 | Vives et al. |
| 2003/0141655 | A1 | 7/2003 | Bryer |
| 2004/0008365 | A1 | 1/2004 | Hobbs |
| 2004/0114024 | A1 | 6/2004 | Bouverie et al. |
| 2004/0165927 | A1 | 8/2004 | Fisher et al. |
| 2005/0002715 | A1 | 1/2005 | Fries et al. |
| 2005/0189693 | A1 | 9/2005 | Ko |
| 2005/0190368 | A1 | 9/2005 | Ehrhardt, Jr. et al. |
| 2005/0204940 | A1 | 9/2005 | Elliott et al. |
| 2006/0007295 | A1 | 1/2006 | Ueda |
| 2006/0045601 | A1 | 3/2006 | Endo |
| 2006/0055721 | A1 | 3/2006 | Burdette et al. |
| 2006/0157911 | A1 | 7/2006 | Learmonth et al. |
| 2006/0159504 | A1 | 7/2006 | Blanchard, Jr. et al. |
| 2006/0180737 | A1 | 8/2006 | Consiglio |
| 2007/0022233 | A1 | 1/2007 | Bridges et al. |
| 2007/0040326 | A1 | 2/2007 | Noda et al. |
| 2007/0059078 | A1 | 3/2007 | Silverbrook et al. |
| 2007/0138738 | A1 | 6/2007 | Motohashi et al. |
| 2009/0038495 | A1 | 2/2009 | Butzen et al. |
| 2009/0103806 | A1 | 4/2009 | Nakami |
| 2009/0244584 | A1 | 10/2009 | McGarry et al. |
| 2010/0066782 | A1 | 3/2010 | Yamamoto et al. |
| 2010/0169513 | A1 | 7/2010 | Levin |
| 2010/0247222 | A1 | 9/2010 | Bouverie et al. |
| 2010/0319561 | A1 | 12/2010 | Colquitt et al. |
| 2011/0042883 | A1 | 2/2011 | Wang et al. |
| 2011/0132643 | A1 | 6/2011 | Hattori et al. |

OTHER PUBLICATIONS

Written Opinion of the International Searching Authority, PCT/US2012/039043, Aug. 3, 2012.
Written Opinion of the International Searching Authority, PCT/US2012/041093, Aug. 7, 2012.
Written Opinion of the International Searching Authority, PCT/US2012/043734, Sep. 21, 2012.
Written Opinion of the International Searching Authority, PCT/US2012/043709, Sep. 21, 2012.
Written Opinion of the International Searching Authority, PCT/US2012/043772, Sep. 14, 2012.
Written Opinion of the International Searching Authority, PCT/US2012/046712, Oct. 5, 2012.
Written Opinion of the International Searching Authority, PCT/US2012/049417, Nov. 2, 2012.
Written Opinion of the International Searching Authority, PCT/US2012/050938, Nov. 6, 2012.
Written Opinion of the International Searching Authority, PCT/US2012/060956, Jan. 11, 2013.
Written Opinion of the International Searching Authority, PCT/US2012/066291, Feb. 5, 2013.

APPARATUS AND METHOD FOR DETERMINING AND ADJUSTING PRINTHEAD PRESSURE

CROSS-REFERENCE TO RELATED APPLICATION(S)

This application claims priority to provisional patent application No. 61/500,719, filed Jun. 24, 2011, and entitled "Apparatus and Method for Determining and Adjusting Printhead Pressure", the contents of which are incorporated in full by reference herein.

FIELD OF INVENTION

The present invention generally relates to printheads utilized in printers, more specifically, to a device and method associated with printheads for determining and providing data to continuously adjust the printhead pressure during a printing operation in thermal printers, such as direct thermal and thermal transfer printers.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include direct thermal printers and thermal transfer printers. For thermal transfer printing on nonsensitized materials such as paper or plastics, a transfer ribbon coated on one side with a heat-transferable ink layer is interposed between the media to be printed and a thermal printhead having a line of very small heater elements. When an electrical pulse is applied to a selected subset of the heater elements, localized melting and transfer of the ink to the paper occurs underneath the selected elements, resulting in a corresponding line of dots being transferred to the media surface.

After each line of dots is printed, the material or printhead is repositioned to locate and print on an adjacent location, the transfer ribbon is repositioned to provide a replenished ink coating, and the selecting and heating process is repeated to print an adjacent line of dots. Depending upon the number and pattern of heaters and the directions of motion of the head and paper, arrays of dots can produce individual characters or, as in the preferred embodiment, successive rows of dots are combined to form complete printed lines of text, bar codes, or graphics.

For direct thermal printing, a heat sensitive media is used along with a thermal printhead having a line of very small heater elements . When an electrical pulse is applied to a selected subset of the heater elements, a thermal reaction to the heat sensitive media occurs underneath the selected elements, resulting in a corresponding line of dots being printed on the media surface.

Applications of such printers include the printing of individual labels, typically pressure-sensitive labels, tickets, and tags. Pressure-sensitive labels are commonly presented on a continuous web of release material (e.g., waxed paper backing) with a gap between successive labels. Tickets and tags may likewise be presented as a continuous web with individual tickets or tags defined by a printed mark or by holes or notches punched therein. Tickets and tags also may likewise be presented on a continuous web with individual tickets or tags defined by a printed mark or by holes, slits, or gaps punched therein.

Such printers also may be adapted to permit the removal of individual labels as they are printed. The construction of the printhead may be such that the web and ribbon are advanced by the length of the inter-label gap plus a significant fraction of an inch after printing of each label and before stopping for removal of the label, in which case the web and ribbon must be backfed an equal distance before printing the next label to avoid leaving an unprintable area of the label.

The power flow to each heater element during energization is relatively constant, being determined by the supply voltage and the electrical resistance of the heater. The energy per printed dot for uniform ink transfer is a function of the web speed and the average printhead temperature. When printing individual labels, the web speed may not be constant, but may be smoothly accelerated and decelerated to allow for inertia of the mechanism. This requires changes in the energization to maintain uniform print quality across the areas printed during speed changes.

Such printers should complete the individual labels as rapidly as practical upon receipt of data therefor. Printing of a label requires three steps: receipt by the controller of a label description in a terse label-description language describing the known objects to be printed, such as text and bar codes but not the dot patterns from which they are formed; formation of the label image in a bit-map memory by the controller, where bits in the map correspond to physical dots in the image; and transfer of the dots forming the label image from bit-map to the printhead, energization of the printhead, and feeding of the web and transfer ribbon as described above. The thermal transfer ribbon may be fed from a supply roll before printing and then taken up on a take-up spindle after use.

Conventional direct thermal printers and thermal transfer printers typically require a manual adjustment of printhead pressure prior to or during the printing operation. This manual adjustment is typically performed via a screw or knob located about the printer's housing and connected to a biasing mechanism affixed to the printhead. Undesirably, these printers have no means of continuously determining and adjusting the pressure of the printhead in proportion to the thickness of media passing thereunder during a printing operation. As a result, the printhead pressure may increase or decrease to undesirable levels. One skilled in the art will appreciate that too much printhead pressure may result in physical wear on the printhead causing failure; while too little pressure on the printhead may result in undesirably light print being transferred onto the media. It would therefore be desirable to provide an apparatus and method operable for determining and adjusting the printhead pressure during a printing operation to provide optimal print quality. It would also be desirable to provide a sensing mechanism connected to the printhead and adapted for determining a set of conditions and communicating with a control circuit operable for controlling a motor drive which can adjust the pressure to pre-defined levels. In addition, the use of conventional thermal transfer printers and more specifically the manual adjustment of the printhead pressure does not account for or maintain a center bias. Thus, there exists a need to utilize a printhead that is operable for adjustment in a synchronized manner thereby maintaining a center bias.

SUMMARY OF THE INVENTION

The present invention is designed to overcome the deficiencies and shortcomings of the systems and devices conventionally known and described above. The present invention is designed to reduce the manufacturing costs and the complexity of assembly. In all exemplary embodiments, the present invention is directed to a printhead assembly for use with a thermal transfer printer. The printhead assembly includes a printhead support housing operable for removable placement in a print station of a thermal transfer printer. The printhead support housing is operable for receiving and housing a motor, a fan, a sensor unit and a printhead. The motor is operable for driving a set of gears that are synchronized together, the gears being mounted about threaded posts that cause the gears to rotate. The rotational movement of the gears compresses a set of biasing mechanisms (e.g., springs) mounted below the gears and connected to the printhead. As the biasing mechanisms are compressed or decompressed, the printhead is moved in relation to media passing under the assembly, thus increasing or decreasing the printhead pressure. A sensor is provided and positioned near the drive train (motor and gears) to sense the position of a sensor gear that contains an integral tab. As the gear is moved, the tab blocks and unblocks the path of several light beams which are emitted from the sensor. By monitoring the emitted light beams, either on or off, software encoded on a control circuit of the printer can determine the current pressure setting of the printhead and make adjustments to correspond to pre-defined levels.

A method of determining and adjusting the printhead pressure is also disclosed herein including the steps of providing a printhead assembly having a motor, a cooling fan and a sensor unit; passing a media under the printhead assembly; during a print operation, determining the position of the printhead in relation to the media and the printhead pressure; comparing the printhead pressure to a pre-defined level; and adjusting the printhead pressure to correspond to the pre-defined level.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

DETAILED DESCRIPTION OF THE PREFERRED EMBODIMENT

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 1:
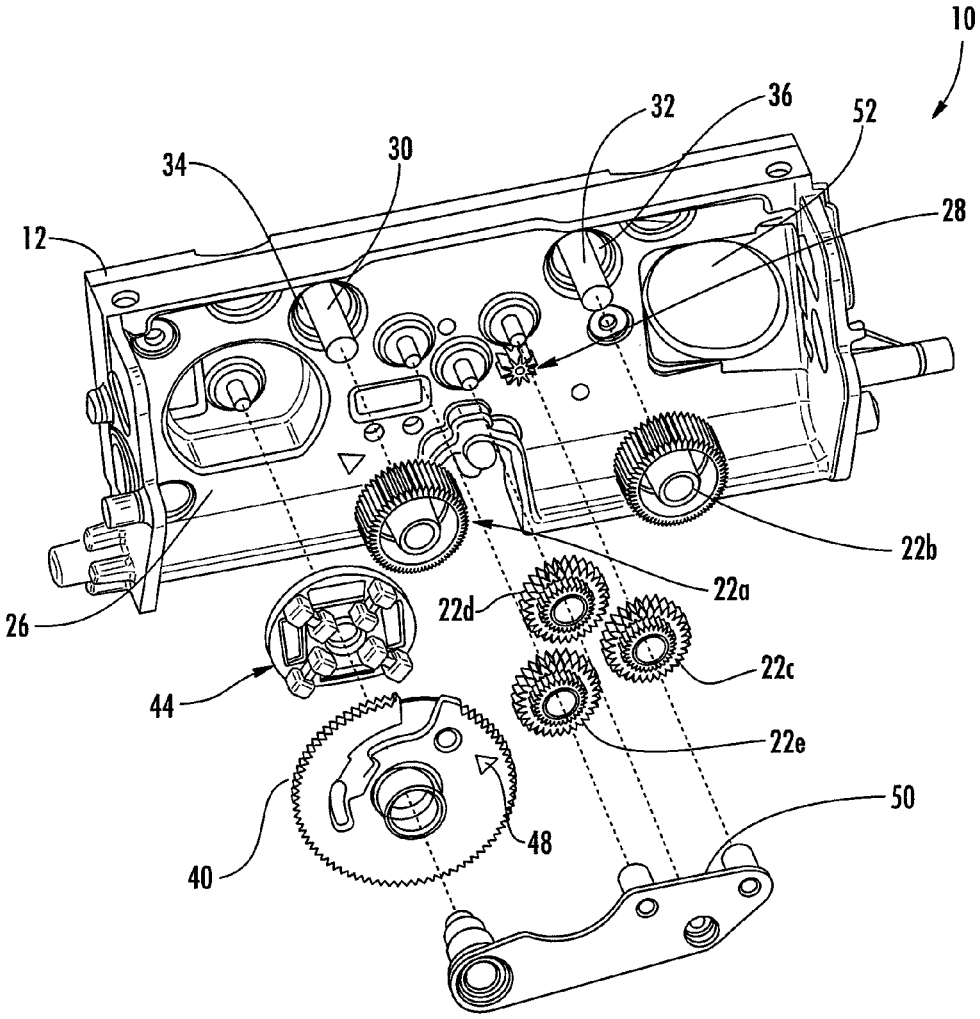
FIG. 1 is a perspective front view of the printhead assembly of the present invention in an open position.
Figure 2:
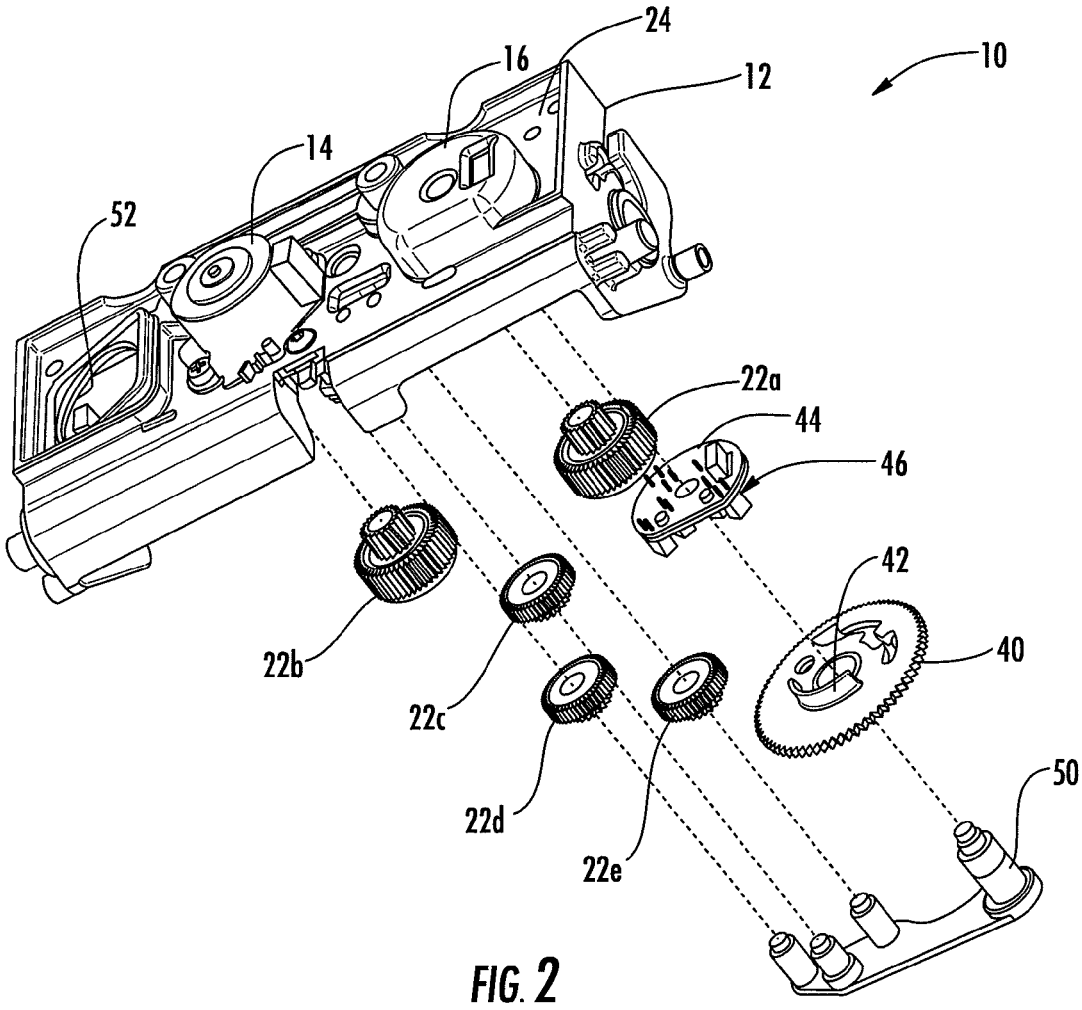
FIG. 2 is a perspective rear view of the embodiment of FIG. 1.
Figure 3:
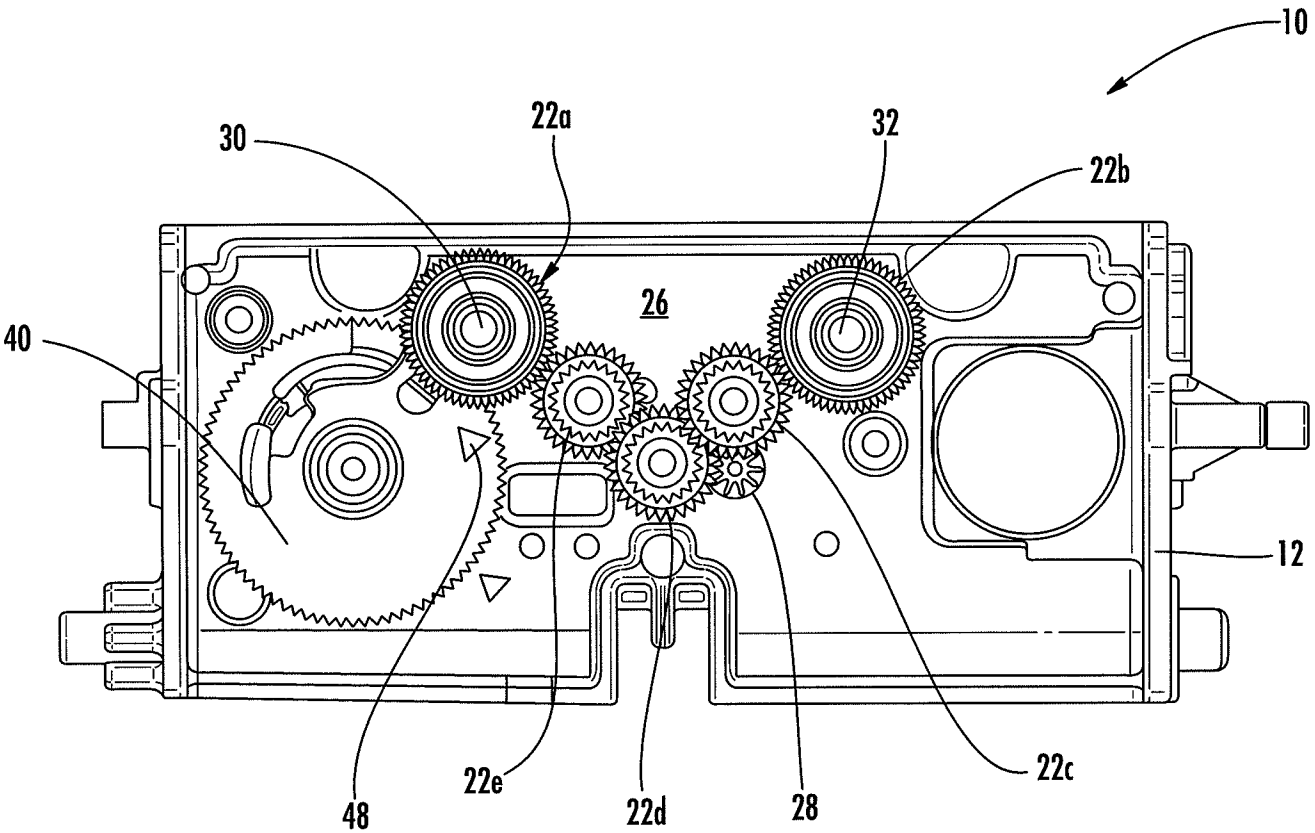
FIG. 3 is a bottom view of the embodiment of FIG. 1.
Figure 4:
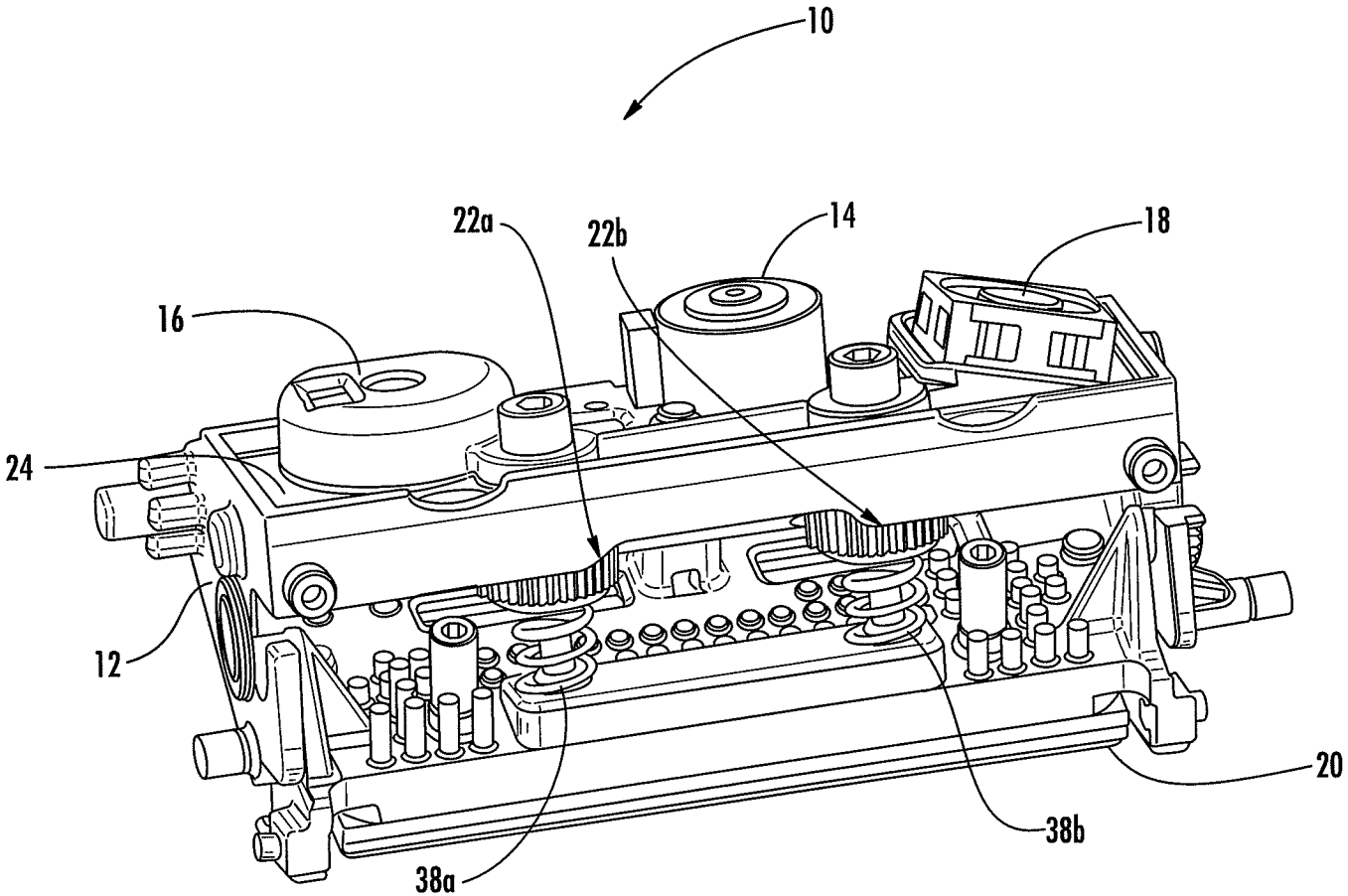
FIG. 4 is a perspective rear view of the embodiment of FIG. 1.

Referring now to the drawings and specifically, FIGS. 1 through 4, a printhead assembly in accordance with exemplary embodiments of the present invention is shown and generally referred to herein by reference numeral 10. The printhead assembly 10 can be operable for controlling the position of a printhead 20 in relation to media (not shown) passing thereunder during a print operation and can include a printhead support housing 12 operable for receiving, housing and supporting a motor 14 connected to a drive train of gears 22*a*, 22*b*, 22*c*, 22*d*, 22*e*, a sensor unit 16, a fan 18 and the printhead 20.

According to aspects of the present invention, the motor 14 can be connected to a top surface 24 of the housing 12 and to a motor drive gear 28 located on the bottom surface 26 of the housing 12. The motor drive gear 28 can be connected to the motor 14 via a shaft (not shown) extending through a port (not shown) of the housing 12. Further, the motor drive gear 28 can be operable for driving a drive train of synchronized gears 22*a*, 22*b*, 22*c*, 22*d*, 22*e* which are disposed within the housing 12 and connected to threaded posts 30, 32 which can extend through the housing 12 via defined ports 34, 36. The motor 14 can be operable for driving the gears 22*a*, 22*b*, 22*c*, 22*d*, 22*e* rotationally as they are rotated. The rotational movement of the gears 22*a*, 22*b*, 22*c*, 22*d*, 22*e* can compress a set of biasing mechanisms 38*a*, 38*b* mounted below the gears 22*a*, 22*b*, 22*c*, 22*d*, 22*e* and connected to the printhead 20. The biasing mechanisms 38*a*, 38*b* can comprise mechanical apparatus, such as, for example, springs or any other biasing mechanism known in the art. Depending on the direction of the rotation of the motor, corresponding to the thickness of the media (not shown), rotational movement of the gears 22*a*, 22*b*, 22*c*, 22*d*, 22*e* can also operate to decompress the set of biasing mechanisms 38*a*, 38*b* mounted below the gears 22*a*, 22*b*, 22*c*, 22*d*, 22*e* and connected to the printhead 20. As the biasing mechanisms 38*a*, 38*b* are compressed or decompressed the printhead 20 is adjusted in relation to the thickness of the media (not shown) passing under the assembly 10, thereby adjusting the printhead pressure.

According to aspects of the present invention, the printhead assembly 20 disclosed herein can be used in a thermal printer (not shown), such as for example, a direct thermal printer (not shown) or a thermal transfer printer (not shown). As used herein, the term "thermal printer" refers to any printer wherein the printing operation performed by the printer involves the transfer of heat from a printhead to a print media and includes a direct thermal printer (not shown) or a thermal transfer printer (not shown).

In exemplary embodiments, the printhead 20 can be of a prior art type having a line of heater elements (not shown) positioned by a pivot such that the heater elements are aligned transverse to motion of media (not shown) passing under the printhead assembly 10. The heater elements (not shown) can be pressed against the media and the media against a platen by the action of the bias mechanisms 38*a*, 38*b*. The heater elements (not shown) can include dome-shaped tips (not shown) and be of finite lengths, thereby forming a line of contact across the media (not shown). The print head 20 can thus be displaced mechanically by the thickness of the media (not shown) when it passes under the heater elements (not shown).

The sensor unit 16 can include a sensor 44 with a light emission and detection means 46 and can be positioned near the motor 14 and gears 22*a*, 22*b*, 22*c*, 22*d*, 22*e*, to sense the position of a sensor gear 40 which can include, for example, an integral tab 42. By way of example, as the sensor gear 40 is rotationally moved, the tab 42 blocks and unblocks the path of several light beams which are emitted from the emission means 46 of the sensor 44. By monitoring which emitted light beams are visible and not blocked by the tab 42, software encoded on a control circuit (not shown) of the printer (not shown) can determine the appropriate pressure setting of the printhead 20 and make adjustments to correspond to pre-defined levels. According to aspects of the present invention, the printhead pressure resolution of the sensor unit 16 contemplated herein is:

$$\text{Res}=(\text{Max. printhead pressure}-\text{Min. printhead pressure})/(2^{*}N-1)$$

Where N is the number of light beams emitted.

In exemplary embodiments, a timing mark 48 is also provided on the sensor gear 40 to enable the sensor unit 16 to obtain data as to the printhead pressure from the control circuit (not shown). It will be understood by those skilled in the art that the timing mark 48 can comprise an aperture disposed at a location on the sensor gear 40. As the sensor gear 40 rotates, light emitted from the sensor 44 can pass through the timing mark 48, thereby providing the printer (not shown) with appropriate printhead pressure data, thereby allowing the pressure of the printhead 20 to be adjusted accordingly.

In exemplary embodiments, gears 22*c*, 22*d*, 22*e*, and sensor gear 40 can be attached to the housing 12 and supported by a cover plate 50. Further, a fan 18 can be provided to cool the motor 14 and heating elements (not shown) of the printhead 20. The fan 18 can be disposed in the housing 12 at a complimentary fan port 52.

A method of determining and adjusting the printhead pressure is also disclosed herein including the steps of providing a printhead support housing 12 operable for placement in a print station (not shown) of a printer (not shown). The printhead support housing 12 can further include a motor 14 housed within the printhead support housing 12 and being operable for driving a plurality of synchronized rotating gears 22*a*, 22*b*, 22*c*, 22*d*, 22*e*, wherein the gears can be mounted about posts 30, 32 wherein the posts 30, 32 are configured to cause the gears 22*a*, 22*b* to compress or decompress a set of biasing mechanisms 38*a*, 38*b* mounted below the gears 22*a*, 22*b* and connected to the printhead 20. A sensor unit 44 can be used for monitoring the thickness of a print media (not shown) can be in communication with a control circuit (not shown) operable for adjusting the printhead pressure to correspond to pre-defined levels. To accomplish this, the control circuit (not shown) can receive a signal from the sensor unit 44 based on the thickness of the print media (not shown) and can send a signal to the motor 14 to rotate the synchronized gears 22*a*, 22*b*, 22*c*, 22*d*, 22*e* to compress or decompress the biasing mechanisms 38*a*, 38*b* attached to the printhead 20, thereby adjusting the pressure against the print media (not shown). The printhead pressure is therefore adjusted relative to the thickness of the print media (not shown).

The embodiments described above provide advantages over conventional devices and associated methods of manufacture. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Furthermore, the foregoing description of the preferred embodiment of the invention and best mode for practicing the invention are provided for the purpose of illustration only and not for the purpose of limitation-the invention being defined by the claims.

What is claimed is:

1. A method for determining and adjusting the pressure to a printhead during a print operation, comprising:

providing a printhead support housing operable for placement in a print station of a printer, said printhead support housing further comprising;

a motor housed within the printhead support housing and being operable for driving a plurality of synchronized rotating gears, said gears being mounted about threaded posts wherein said threaded posts are configured to cause said gears to compress or decompress a set of biasing mechanisms mounted below said gears and connected to said printhead; and a sensor unit operable for monitoring the thickness of a print media and in communication with a control circuit operable for adjusting the printhead pressure to correspond to pre-defined levels, wherein said control circuit receives a signal from said sensor unit based on the thickness of the print media and further sends a signal to said motor to rotate said synchronized gears to compress or decompress said biasing mechanisms attached to said printhead and thereby adjusting the pressure against the print media.

2. The method of claim 1 wherein said printer is a thermal printer.

3. The method of claim 2 wherein said printhead comprises heater elements.

4. The method of claim 2 wherein said printhead support housing further comprises a fan for cooling said printhead assembly.

5. The method of claim 1 wherein said printhead assembly is removable.

6. The method of claim 1 wherein said biasing mechanisms comprise springs.

7. The method of claim 1 wherein said sensor unit further comprises a plurality of light beams and sensors configured to detect light emitted from said light beams.

8. The method of claim 1 wherein said pre-defined levels are relative to the thickness of said print media.

9. A printhead assembly for determining and adjusting the pressure to a printhead during a print operation, comprising:

a printhead support housing operable for placement in a print station of a printer;

a motor housed within the printhead support housing and being operable for driving a plurality of synchronized rotating gears, said gears being mounted about threaded posts wherein said threaded posts are configured to cause said gears to compress or decompress a set of biasing mechanisms mounted below said gears and connected to said printhead; and a sensor unit operable for monitoring the thickness of a print media and in communication with a control circuit operable for adjusting the printhead pressure being applied to said print media during a print operation, wherein said printhead pressure corresponds to a predefined level.

10. The printhead assembly of claim 9 wherein said printer is a thermal printer.

11. The printhead assembly of claim 10 wherein said printhead comprises heater elements.

12. The printhead assembly of claim 10 wherein said printhead support housing further comprises a fan for cooling said printhead assembly.

13. The printhead assembly of claim 9 wherein said printhead assembly is removable.

14. The printhead assembly of claim 9 wherein said biasing mechanisms comprise springs.

15. The printhead assembly of claim 9 wherein said sensor unit further comprises a plurality of light beams and sensors for detecting light emitted from said light beams.

16. The printhead assembly of claim 9 wherein said predefined levels are relative to the thickness of said print media.

17. A printhead assembly for determining and adjusting the pressure to a printhead during a thermal print operation, comprising:

a printhead support housing operable for removable placement in a print station of a thermal printer;

a printhead comprising a plurality of heater elements;

a fan disposed in said printhead support housing configured to cool said printhead assembly;

a motor housed within the printhead support housing and being operable for driving a plurality of synchronized rotating gears, said gears being mounted about posts wherein said posts are threaded to cause said gears to compress or decompress a set of biasing mechanisms mounted below said gears and connected to said printhead;

a sensor unit operable for monitoring the thickness of a print media and in communication with a control circuit operable for adjusting the printhead pressure being applied to said print media during a print operation, wherein said printhead pressure corresponds to a predefined level relative to the thickness of said print media.

18. The printhead assembly of claim 17 wherein said sensor unit further comprises a plurality of light beams and sensors configured to detect light emitted from said light beams.

* * * * *